US007293696B2

(12) United States Patent
Laborde

(10) Patent No.: US 7,293,696 B2
(45) Date of Patent: Nov. 13, 2007

(54) MAILBOX

(76) Inventor: Carpenter Laborde, 72 Fairfax, North Coram, NY (US) 11727

( * ) Notice: Subject to any disclaimer, the term of this patent is extended or adjusted under 35 U.S.C. 154(b) by 0 days.

(21) Appl. No.: 11/066,935

(22) Filed: Feb. 26, 2005

(65) Prior Publication Data

US 2006/0191988 A1 Aug. 31, 2006

(51) Int. Cl.
*A47G 29/12* (2006.01)

(52) U.S. Cl. ..... 232/38; 232/39; 40/566; 40/606.06

(58) Field of Classification Search ..... 232/38, 232/17, 39; 40/566, 606.06; 362/154; D99/29–32
See application file for complete search history.

(56) References Cited

U.S. PATENT DOCUMENTS

| | | | | |
|---|---|---|---|---|
| 5,143,285 | A * | 9/1992 | Wise | 232/39 |
| D356,423 | S * | 3/1995 | Kresin | D99/32 |
| 5,460,325 | A * | 10/1995 | Surman | 232/17 |
| 5,522,540 | A * | 6/1996 | Surman | 232/17 |
| 6,601,968 | B2 * | 8/2003 | Voacolo | 362/154 |
| 6,629,634 | B2 * | 10/2003 | Simmons | 232/45 |
| 6,629,766 | B2 * | 10/2003 | Cathel | 362/183 |
| 6,708,876 | B1 * | 3/2004 | Shirah | 232/38 |
| 6,719,193 | B2 * | 4/2004 | Katulka | 232/38 |
| 6,799,716 | B1 * | 10/2004 | Kuelbs | 232/39 |
| 6,964,366 | B2 * | 11/2005 | Peng et al. | 232/38 |
| 2004/0083634 | A1 * | 5/2004 | Blsson et al. | 40/566 |
| 2006/0104055 | A1 * | 5/2006 | Bossomo | 362/154 |
| 2006/0118609 | A1 * | 6/2006 | Iannello | 232/38 |

* cited by examiner

*Primary Examiner*—William L. Miller
(74) *Attorney, Agent, or Firm*—I. Zborovsky

(57) ABSTRACT

A mailbox has a housing having a plurality of walls, and a light source arranged so as to emit light into an interior of the housing, wherein the housing has at least one transparent wall through which the light emitted by the light source into the interior of the housing passes.

8 Claims, 3 Drawing Sheets

MAILBOX

BACKGROUND OF THE INVENTION

The present invention generally relates to mailboxes.

Mailboxes are known and widely used for receiving mail distributed by postal workers and taking mail by consumers. The existing mailboxes generally have substantially housings which limit an interior of the mailbox for accommodating mail. In many instances the mailboxes are attached to walls of houses, buildings, etc., and in other cases they are supported on free-standing posts. As a rule, the existing mailboxes are not illuminated.

Some mailboxes are known which have an illumination source arranged outside of the housing, in particular on the top of the housing so that the mailbox can be visible when there is no sufficient exterior illumination. It is believed that the existing mailboxes can be further improved.

SUMMARY OF THE INVENTION

Accordingly, it is an object of the present invention to provide a mailbox which is a further improvement of the existing mailboxes.

In keeping with these objects and with others which will become apparent hereinafter, one feature of the present invention resides, briefly stated in a mailbox which has housing with a plurality of walls and a light source arranged so as to emit light into an interior of the housing, wherein the housing has at least one transparent wall through which the light emitted by the light source into the interior of the housing can pass.

When the mailbox is designed in accordance with the present invention, the light emitted by the light source into the interior of the mailbox passes through the transparent wall and is visible from outside of the mailbox.

The transparent wall can be used just for allowing the light to pass through it so that the mailbox is illuminated. On the other hand, it can be used for illumination of additional decorative or useful elements. For example, on the transparent wall of the mailbox it is possible to exhibit decorative patterns, house numbers, etc.

The transparent wall can be either integral with and non-removable from the housing, or can be formed by a removable and replaceable transparent wall. Also, an additional element can be attached outside the transparent wall and provided with decorative or useful information. The information on the transparent wall or on the additional element can be for example an advertisement, a flag, a symbol of a sports team, an announcement of an event, for example a birthday, etc.

In accordance with an important feature of the present invention, the light source can be a solar power light source. In this case the light source emits light into the interior of the housing, while a solar panel is arranged on an outer surface of the housing and connected with the light source in the light housing. It is possible to arrange two solar panels on a top wall of the housing, and make a portion of the top wall between the solar panels transparent.

Also, it is possible to provide transparent walls of the housing on the lateral sides of the housing, on the top of the housing, on the bottom of the housing, and even to make a mailbox door transparent as well. The door can also include either a non-removable transparent part, or a removable and replaceable transparent part.

In accordance with still a further feature of the present invention, the light which is emitted by the light source into the interior of the housing can penetrate into an interior of a post which supports the housing and which also has a transparent wall through which light can pass as well. On the other hand, for the mailboxes which are attached to walls and do not have a post, a projection can extend from the bottom wall of the housing, and the bottom wall can have at least one transparent portion through which light passes and illuminates the projection, while the projection can be decorative or bear a house number, etc.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
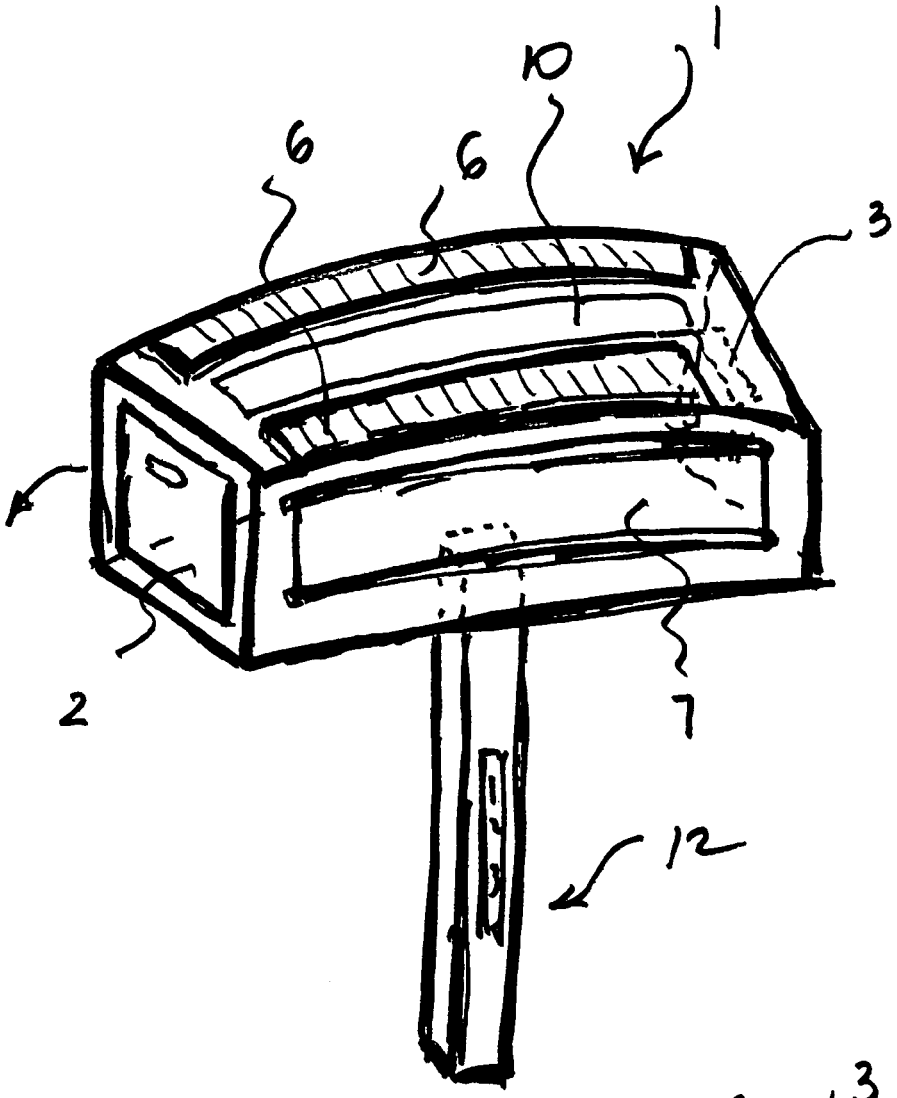
FIG. 1 is a perspective view of a mailbox in accordance with the present invention.

A mailbox in accordance with the present invention has a housing which is identified as a whole with reference numeral 1. The housing has a plurality of walls which together define an interior of the housing. A door 2 is provided for opening the interior of the housing for introduction of mail into it and removal of mail from it, and for closing the housing. It can be pivotally connected with the housing, as known in the art.

In accordance with the present invention, a light source 3 is provided. The light source 3 is formed and arranged so that it emits the light into the interior of the housing 1. The light source 3 has a light-emitting element 4 which can be arranged in a light housing 5 attached to a rear wall of the housing 1 so as to emit light into the interior of the housing 1. In the shown embodiment the light source 3 is formed as a solar power light source. It has at least one solar panel, preferably two solar panels 6 which are arranged outside of the housing on one of its walls, for example on a top wall of the housing 1, and electrically connected with the light-emitting element 4 through a connection which is known per se in the art.

In accordance with the present invention, at least one wall of the housing 1 is transparent. As shown in FIG. 1, two walls which are side walls of the housing 1 and identified with reference numeral 7 are transparent. Therefore, the light which is emitted by the light-emitting element 4 of the light source 3 can pass through the transparent walls 7.

Figure 3:
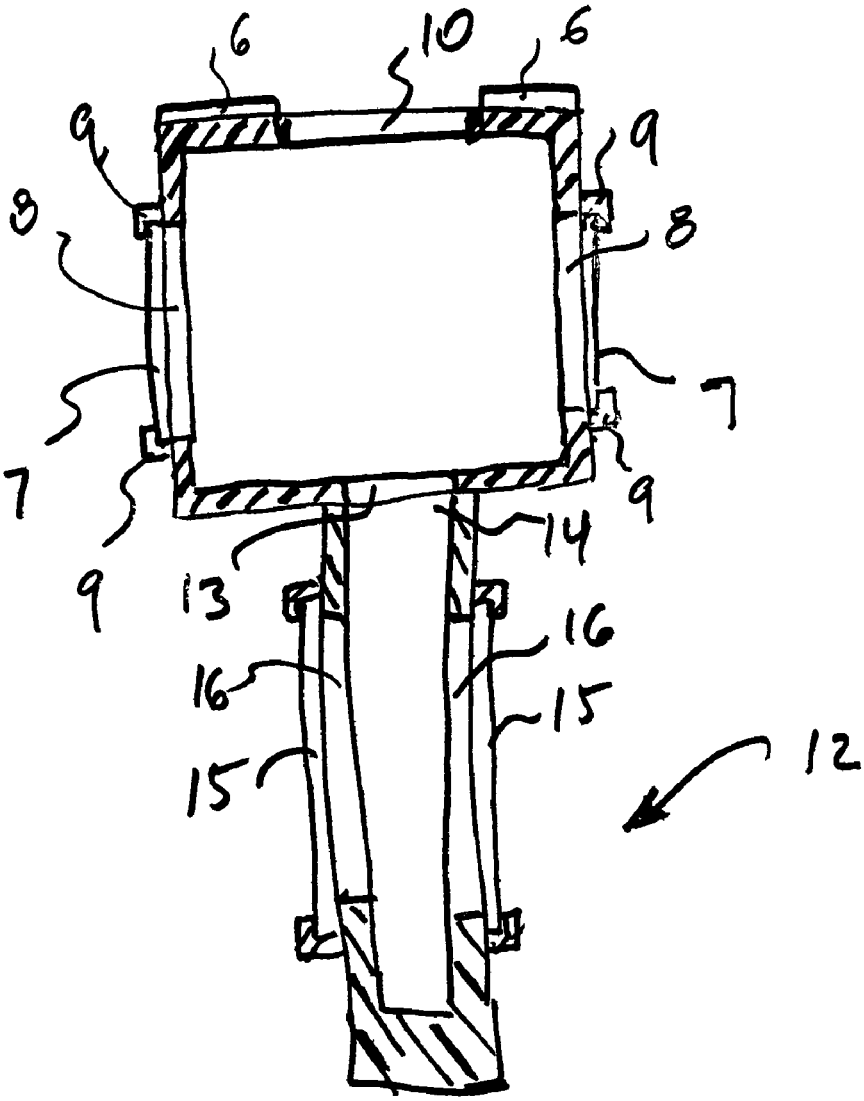
FIG. 3 is a view showing a vertical transverse cross-section of the mailbox of FIG. 1.

As shown in FIG. 3 the transparent walls 7 can be formed by elements which are arranged adjacent to side openings 8 in lateral walls of the housing 1, so that the light passes through the openings 8 and then through the transparent elements 7. On the other hand, the openings 8 can accommodate transparent portions of the lateral walls of the housing 1, so that the light emitted by the light-emitting element 4 passes first through the transparent portions arranged in the openings 8, and then through the transparent elements. Also, it is possible to make the transparent element 7 integral of one piece with the walls of the housing.

The transparent walls and elements can be formed for example for purely decorative purposes, for which purpose they can be composed of a colored transparent material, can bear patterns, etc. They can also be provided with special information elements, for example they can bear a house number, an apartment number and the like, they can bear an image of a flag, a logo of a sports team, an advertising, an announcement of birthday party in the house, etc. The light emitted by the light-emitting element 4 of the light source 3 illuminates the corresponding transparent walls and images on them.

The housing 1 can be composed for example of plastic with corresponding transparent portions or corresponding openings. It can also be composed of metal, or at least have a metal frame, with the corresponding openings and transparent elements.

As can be seen from FIGS. 1 and 3, a top wall of the housing 1 can also have at least a portion 10 composed of a transparent material, similarly to the side walls of the housing. The transparent portion 10 can be located between the solar panels 6.

The transparent walls of the housing can be formed as integral walls which are non-removably connected with a remaining portion of the housing. On the other hand, they can be formed as removable elements, for example as shown in FIG. 3. For this purpose guides 9 are provided on corresponding walls of the housing 1, and the transparent walls 7 or elements are insertable into the guides and removable from the guides to be replaced by other transparent walls as desired.

The door 2 can be also composed of a transparent material, or at least a portion of the door 2 can be composed of a transparent material and formed as the transparent walls 7, to carry information, pattern, etc. In addition to illuminating the corresponding transparent wall portions of the housing 1, the light in the interior of the mailbox in accordance with the present invention provides also an additional function. When the light emitted by the light-emitting element 4 is not seen through the transparent walls, this means that the mail is still inside the mailbox and blocks the corresponding transparent portions. This alerts an owner to take the mail out of the mailbox.

In accordance with a further feature of the present invention, the mailbox in accordance with the present invention is provided with a post which supports the housing 1 and is identified with reference numeral 12. The post 12 of the present invention can be formed with an additional inventive feature. In particular, it can have a hollow interior and can be provided with at least one side wall, preferably two side walls 15, which are transparent and formed similarly to the transparent walls 7 of the housing 1. The transparent side walls 15 can be placed outside of the openings 16 in the hollow post 12, and formed either integral with the post or arranged removably in the corresponding guides.

In order to illuminate the post from inside, a bottom wall of the housing 1 can be provided at least with a transparent portion 13 which is in alignment with an upper opening 14 of the post 12, so that the light emitted by the light source 4 of the light-emitting element 3 propagates through the interior of the housing 1 into the interior of the post 2 and passes through the transparent walls 15.

Figure 4:
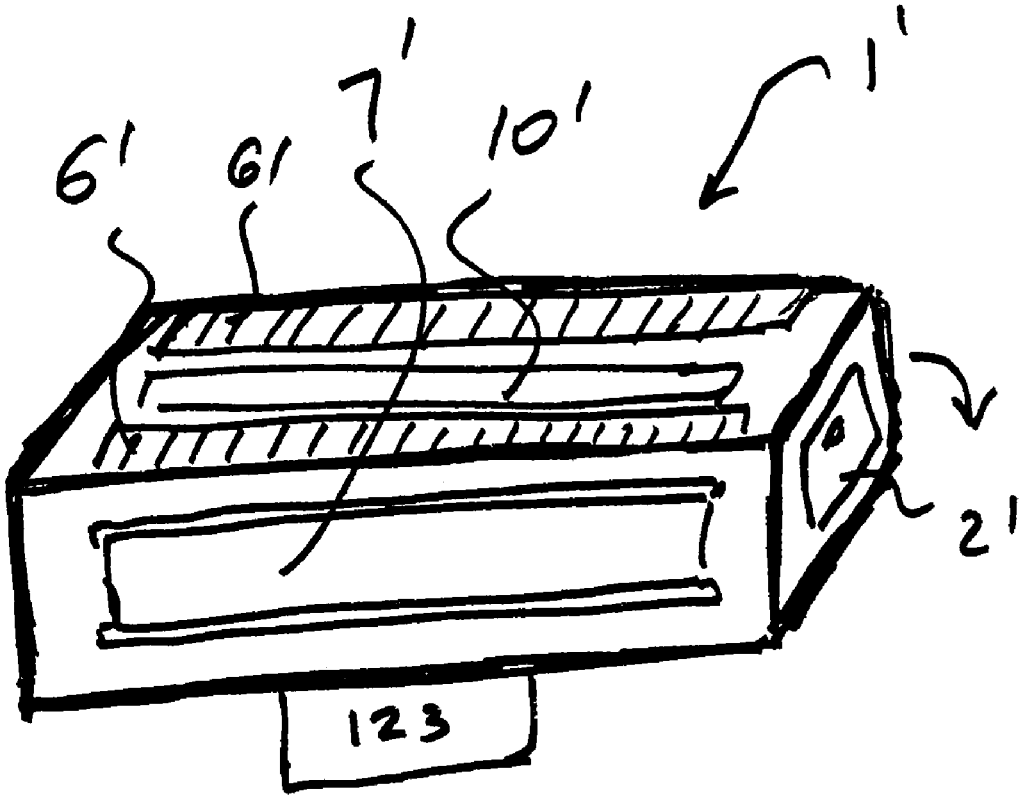
FIG. 4 is a perspective view of a mailbox in accordance with another embodiment of the invention.
Figure 5:
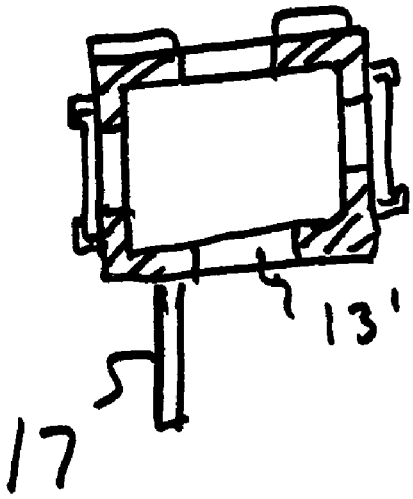
FIG. 5 is a view showing a vertical transverse cross-section of the mailbox of FIG. 4.

Another embodiment of the mailbox shown in accordance with the present invention is shown in FIGS. 4 and 5. It is used mainly for mailboxes which are attachable to walls and do not have a post. The mailbox shown in FIGS. 4 and 5 has a housing 1' with at least one transparent wall, preferably two transparent walls 7' formed as the transparent walls 7 of the embodiments shown in FIG. 1. Two solar cells 6' are arranged on a top wall of the housing 1', and the top wall has a transparent portion 10'. The door 2' closes and opens an interior of the mailbox.

The mailbox shown in FIGS. 4 and 5 has a downwardly extending projection 17 which can be provided with information, data, etc., for example a house number, an apartment number, etc. The bottom wall of the housing 1' has a transparent portion 13', so that the light emitted by the not shown light emitting element of the light source passes through the transparent portion 13' and illuminates the projection 17 with information provided on it.

Figure 2:
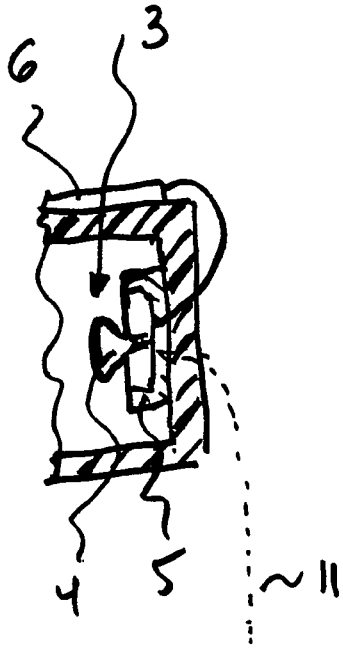
FIG. 2 is a view showing a fragment of the mailbox with a light source.

While in the preferable embodiment the light source is a solar power light source, it is possible to use another light source, for example an electrical system of ground illuminating devices, an electrical system of an apartment or a housing connectable to the light-emitting element 4 for example through a conductor 11 as shown in FIG. 2. This additional light source can be used instead of a solar power light source, or in addition to the solar power light source.

It will be understood that each of the elements described above, or two or more together, may also find a useful application in other types of constructions differing from the types described above.

While the invention has been illustrated and described as embodied in a mailbox, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mailbox, comprising a housing having a plurality of walls top wall, two side walls, a rear wall, and a bottom wall defining an interior of the housing for receiving mail within the interior of said housing; a light source arranged within the interior of said housing so as to emit light into the interior of said housing, at least one of said top wall and said two side walls being a transparent wall through which the light emitted by said light source into the interior of said housing passes; and a post for supporting said housing, said post being hollow and having an interior into which light emitted by said light source into the interior of said housing passes, wherein said bottom wall is a transparent wall, while said post has a top opening adjoining said transparent bottom wall, so that light emitted by said light source into the interior of said housing passes through said transparent bottom wall and said top opening of said post into the interior of said post; said post having at east one transparent wall through which the light in the interior of said post passes.

2. A mailbox as defined in claim 1, wherein said so that the light emitted by said light source into the interior of said housing passes through said two transparent side walls.

3. A mailbox as defined in claim 1, wherein said top wall and said two said walls are each transparent walls transparent walls include two side walls, a top wall, and a bottom wall of said housing.

4. A mailbox as defined In claim 1; and further comprising a door which is openable and closable for introduction of the mail into the interior of said housing and for removal of the mail from the interior of said housing, said door being transparent so that the light emitted by said light source into the interior of said housing passes through said door.

5. A mailbox as defined in claim 1; and further comprising an additional element which is attachable to said housing and illuminatable by the light which passes through said at least one transparent of said housing.

6. A mailbox as defined in claim 1, wherein said at least one transparent wall of said housing is removable from said housing and replaceable by another transparent wall.

7. A mailbox as defined in claim 1, wherein said light source is a solar power light source and has at least one solar panel attached to an outer side of said housing.

8. A mailbox as defined in claim 7, wherein said at least one solar panel has two panel elements arranged on said top wall of said housing, said at least one transparent wall of said housing being formed at a portion of said top wall between said panel elements.

* * * * *